United States Patent [19]

Bourgeois

[11] 4,434,853

[45] Mar. 6, 1984

[54] OIL WELL BLOW OUT CONTROL VALVE

[75] Inventor: Dale M. Bourgeois, Houma, La.

[73] Assignees: Wayne Bourgeois; LeRoy Hebert, both of Houma, La. ; part interest to each

[21] Appl. No.: 387,510

[22] Filed: Jun. 11, 1982

[51] Int. Cl.[3] ..... E21B 33/068

[52] U.S. Cl. ..... 166/285; 166/85; 166/88; 166/387; 251/1 A

[58] Field of Search ..... 166/85, 387, 88, 285, 166/82, 90; 251/1 A, 1 B, 1 R

[56] References Cited

U.S. PATENT DOCUMENTS

| | | | |
|---|---|---|---|
| 1,836,508 | 12/1931 | Rasmussen | 166/85 |
| 3,207,221 | 9/1965 | Cochran et al. | 166/85 |
| 3,478,822 | 11/1969 | Holbert et al. | 166/88 |

*Primary Examiner*—Stephen J. Novosad
*Assistant Examiner*—Michael Starinsky
*Attorney, Agent, or Firm*—Harvey B. Jacobson

[57] ABSTRACT

An upright tubular housing is provided for downward telescoping over the upper end of a well production tubing and includes three axially spaced and inwardly projecting annular abutments sealingly mounted in the housing. Upper and lower annular axially compressible and radially expandable seal assemblies are disposed in the housing between pairs of adjacent abutments. The housing includes inner generally radially shiftable clamp jaws for tight clamping engagement with the opposing outer surfaces of the tubing and pressurizing fluent material inlet means is provided for admitting seal assembly pressurizing fluent material into the area within the housing disposed between the upper and lower seal assemblies. Further, the upper end of the housing is equipped with a full opening control valve and pressurizing mud inlet means intermediate the control valve and the uppermost seal assembly.

13 Claims, 4 Drawing Figures

OIL WELL BLOW OUT CONTROL VALVE

BACKGROUND OF THE INVENTION

There are various instances during which it is desirable to utilize an oil well blow out control valve on the upper end of a well production tubing. Various forms of blow out control valves heretofore have been provided such as those disclosed in U.S. Pat. Nos.: 3,040,763, 3,137,348, 3,207,221, 3,589,667 and 3,720,260.

However, some of these previously known forms of blow out control valves are quite complex in structure and are thus expensive to manufacture and use. Further, other previously known forms of control valves do not include structure capable of forming a high pressure fluid-tight seal between the control valve and the associated production tubing, while others do not include structure for admitting mud into the production tubing after the control valve has been mounted on the production tubing and closed.

Accordingly, a need exists for an improved mechanically simplified form of blow out control valve which will be inexpensive to manufacture and use and also capable of forming a high pressure fluid-type seal between the control valve and the associated production tubing.

SUMMARY OF THE INVENTION

The blow out control valve of the instant invention utilizes an upstanding tubular housing to be downwardly telescoped over the upper end of a production tubing and the housing includes novel axially compressible and radially expandable seal structure as well as internal fluid actuated clamping jaws for securely attaching the control valve to an associated production tubing upper end and also providing a high pressure fluid-tight seal between the production tubing and the control valve. In addition, the control valve includes high pressure mud inlet structure for admitting mud into the housing of the control valve below the valve assembly thereof and above the uppermost seal whereby mud admitted into the housing may be pumped down through the production tubing. Further, the pressure of mud being pumped down into the production tubing serves to facilitate axial compression of the upper seal structure of the control valve and the control valve additionally includes inlet structure for admitting fluent sealing material into the interior of the housing intermediate the upper and lower seal assemblies thereof for pressurizing both seal assemblies and forming a fluid-tight bond between the housing of the control valve and the opposing outer surfaces of the production tubing.

The main object of this invention is to provide a well blow out control valve which may be effectively utilized to close off the upper end of a section of production tubing in an efficient manner.

Another object of this invention is to provide a control valve including simplified structure for tightly clampingly engaging the associated well tubing, forming a fluid-tight seal with the tubing and also bonding the valve to the tubing with a hardenable fluent seal material.

Still another important object of this invention is to provide a blow out control valve including structure whereby mud may be pumped into the interior of the control valve below the valve component thereof and above the uppermost seal of the control valve engaged with the associated production tubing.

A final object of this invention to be specifically enumerated herein is to provide a well blow out control valve in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
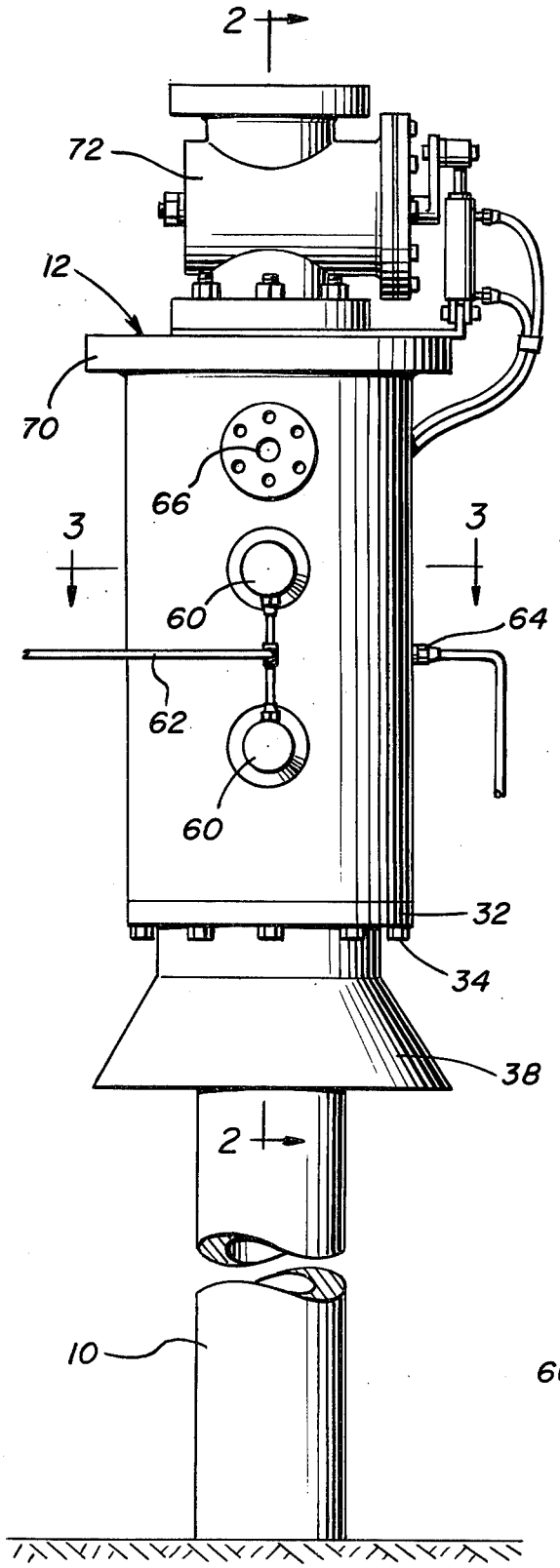
FIG. 1 is an elevational view of the control valve as operatively mounted on the upper end of a production tubing.
Figure 3:
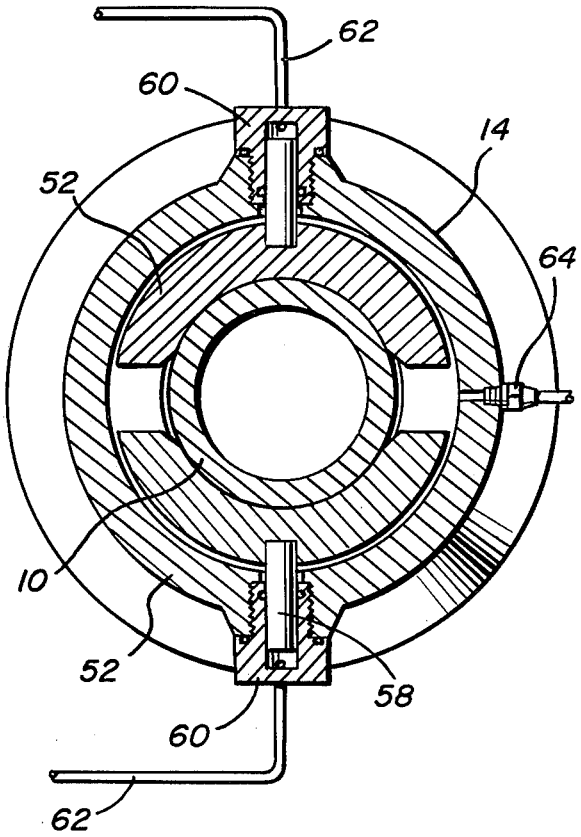
FIG. 3 is an enlarged horizontal sectional view taken substantially upon the plane indicated by the section line 3—3 of FIG. 1.
Figure 4:
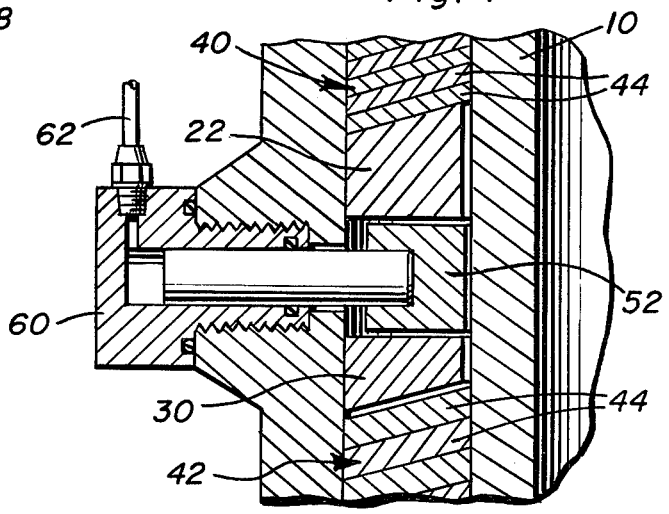
FIG. 4 is an enlarged fragmentary vertical sectional view illustrating the manner in which one of the clamping jaws and the hydraulic actuater therefor is supported from the housing of the control valve.

Referring now more specifically to the drawings, the numeral 10 generally designates the upper end of a production tubing of a well and the numeral 12 generally designates the blow out control valve of the instant invention.

The control valve 12 includes a cylindrical housing 14 including an upper end portion 16 and a lower end portion 18 and the interior of the housing 14 includes axially spaced upper and lower annular and radially inwardly projecting abutment assemblies 20 and 22. The abutment assembly 20 comprises upper and lower annular abutment rings 24 and 26 sealingly secured to the inner surfaces of the upper end portion 16 of the housing 14 in slightly axially spaced relation and the abutment assembly 22 comprises similar upper and lower abutment rings 28 and 30 sealingly secured to the inner surfaces of the lower end portion 18 of the housing 14 in slightly axially spaced relation.

The lower end portion 18 of the housing 14 includes a lower annular end wall 32 secured thereto through the utilization of suitable fasteners 34 and the end wall 32 includes a radially inwardly projecting and circumferentially extending abutment assembly 36 spaced below the abutment ring 30 of the abutment assembly 22. The annular end wall 32 also defines a downwardly flared conical mouth 38 for a purpose to be hereinafter more fully set forth.

Interposed between the abutment assembly 20 and the abutment assembly 22 is an annular seal assembly referred to in general by the reference numeral 40 and a similar annular seal assembly referred to in general by the reference numeral 42 is disposed between the abutment assembly 22 and the abutment assembly 36. Each of the seal assemblies 40 and 42 includes a plurality of axially abutting annual seal discs 44 interposed between the annular shoulders defined by the opposing faces of the adjacent abutment rings and it will be noted that the undersurfaces of the abutment rings 26 and 30 are concave truncated cone shaped, while the upper surfaces of the abutment ring 28 and the abutment assembly 36 are upwardly convex truncated cone shaped. Further, the seal discs 44 are axially compressible and radially expandable. Still further, it will be noted that the inside diameters of the rings 24, 26, 28, 30 and the inside diameter of the abutment assembly 36 are substantially identical and slightly greater than the outside diameter of the production tubing 10.

An annular groove 48 is defined between the abutment rings 24 and 26 and a similar groove 50 is defined between the annular rings 28 and 30. A pair of generally semi-cylindrical clamping jaws 52 and 54 are disposed in each of the grooves 48 and 50 and have radially outwardly opening blind bores 56 formed therein in which the radial innermost ends of corresponding radial pistons 58 are seated. The pistons 58 are slidably received through suitable openings provided therefor in the housing 14 and the outer ends of the pistons are slidingly received in cylinder defining fittings 60 threadedly supported from the housing 14. Each of the fittings 60 includes a fluid inlet with which a fluid supply line 62 is communicated and, accordingly, fluid under pressure may be admitted into the fittings outwardly of the pistons 58 in order to force the latter radially inwardly and thus cause the jaws 52 to tightly clampingly engage the production tubing 10.

In addition, the housing 14 is provided with a fluid inlet fitting 64 which opens into the groove 50. A fluent hardenable seal material may be admitted into the groove 50 through the fitting 64 and used to pressurize the adjacent axial ends of the seal assemblies 40 and 42. Thus, the seal discs 44 may be axially compressed and radially expanded into tight seal engagement with the opposing inner surfaces of the housing 14 and the opposing outer surfaces of the production tubing 10.

Figure 2:
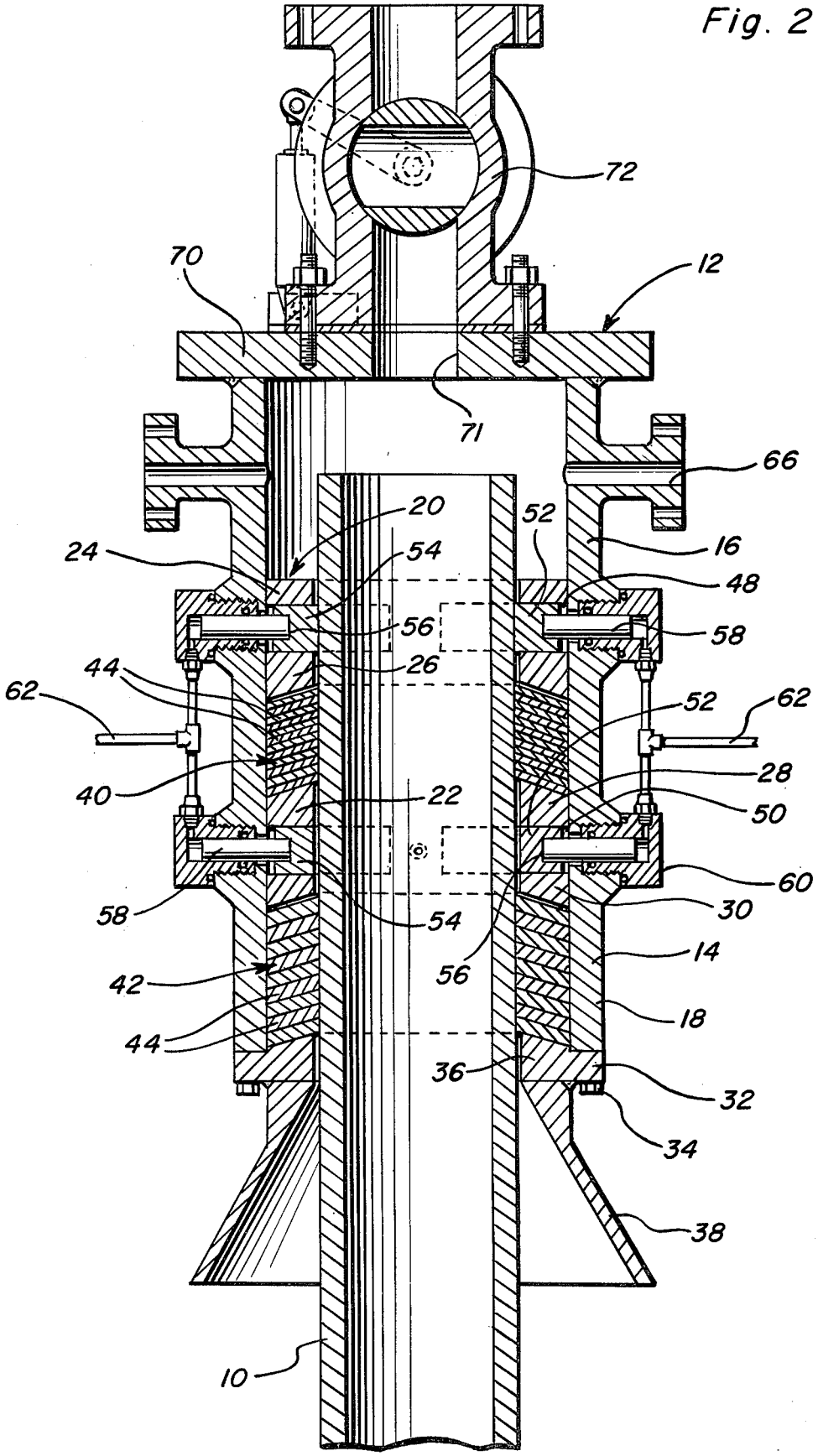
FIG. 2 is an enlarged vertical sectional view taken substantially upon the plane indicated by the section line 2—2 of FIG. 1.

As may best be seen from FIG. 2 of the drawings, the upper end portion 16 of the housing 14 is provided with a pair of radially outwardly opening mud inlet fittings 66 to which high pressure mud supply lines (not shown) may be connected and mud may thus be admitted into the upper end portion 16 of the housing 14 above seal discs 44 for downward movement through the production tubinbg 10. In addition, the admission of mud under pressure into the upper end portion 16 of the housing 14 serves to provide additional pressure for axially compressing the seal discs 44 of the seal assembly 40 from above.

The upper end of the housing 14 includes an upper end wall 70 secured thereover and the upper end wall 70 has a central opening 71 formed therethrough with which a full opening and hydraulically actuated control valve 74 removably supported from the end wall 70 is registered. The control valve 74 may thus be operated from a remote location.

In operation, if the production tubing 10 experience a "blow out", the control valve 12 may be hoisted into position above the upper end of the production tubing with the valve 72 in an open position. If it is desired, the control valve 12 may be suitably weighted. Thereafter, the control valve 12 is lowered and the downwardly flared mouth 38 serves to center the housing 14 relative to the production tubing 10 during lowering of the housing 14 over the upper end of the tubing 10. After the housing 14 has been positioned approximately as illustrated in FIG. 1 of the drawings, fluid under pressure may be applied to the pistons 58 in order that the jaws 52 may tightly clamp the control valve 12 in position on the production tubing 10. Thereafter, a suitable hardenable fluent seal material may be admitted into the groove 50 through the fitting 64 in order to axially compress the upper and lower sealed discs 44 from below and above, respectively, and the seal material may be allowed to harden in order to maintain the discs 44 axially compressed and radially expanded and to form a further seal, by the seal material, between the tubing 10 and the housing 14. Thereafter, the valve 72 may be closed and mud may be admitted into the upper end portion of the housing 14 through the fittings 66 under pressure whereby the mud may be pumped down through the production tubing 10 and also serve to axially compress the sealed discs 44 of the seal assembly 40 from above.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A well blow out control valve assembly, said assembly including an upright tubular housing having upper and lower ends, said housing being adapted to be downwardly telescoped over the upper end of a well production tubing and including three axially spaced radially inwardly projecting circumferential annular abutments sealingly mounted therein, upper and lower annular axially compressible and radially expandable seal assemblies disposed in said housing between pairs of adjacent abutments, at least one of said abutments including inwardly shiftable clamp jaws supported therefrom for generally radial inward shifting into tight clamping engagement with the opposing outer surfaces of said tubing, and pressure fluent material inlet means opening into the interior of said housing intermediate said seal assemblies whereby fluent material under pressure may be admitted into said housing intermediate said seal assemblies for pressurizing the latter from adjacent sides thereof.

2. The control valve assembly of claim 1 wherein said one abutment comprises a pair of axially spaced abutment rings stationarily and sealingly secured in said housing and defining an annular groove therebetween, said clamp jaws comprising a plurality of arcuate jaw members received in and shiftable generally radially of said groove.

3. The control valve assembly of claim 2 wherein the other of said annular abutments also comprises a pair of axially spaced abutment rings stationarily and sealingly secured in said housing and defining a second annular groove therebetween, an a plurality of additional arcuate jaw members received in and shiftable generally radially of the last mentioned groove.

4. The control valve assembly of claim 1 wherein the upper end of said housing includes a control valve supported therefrom shiftable between open and closed positions opening for and closing the upper end of said housing.

5. The control valve assembly of claim 4 including means for admitting fluent material under pressure into the interior of the upper end of said housing intermediate said control valve and said one abutment.

6. The control valve assembly of claim 5 wherein said one abutment comprises a pair of axially spaced abutment rings stationarily and sealingly secured in said housing and defining an annular groove therebetween, said clamp jaws comprising a plurality of arcuate jaw members received in and shiftable generally radially of said groove.

7. The control valve assembly of claim 6 wherein the other of said annular abutments also comprises a pair of axially spaced abutment rings stationarily and sealingly secured in said housing and definingg a second annular groove therebetween, an a plurality of additional arcuate jaw members received in and shiftable generally radially of the last mentioned groove.

8. The control valve assembly of claim 7 including fluid pressure actuated motor means operatively connected with said jaw members for displacing the latter radially inwardly into tight clamping engagement with said production tubing.

9. The control valve assembly of claim 8 wherein the lower end of said housing includes means defining a downwardly flared mouth for guiding said housing into position concentric with said production tubing as said housing is downwardly telescoped over the upper end of said production tubing.

10. The method of forming a fluid-tight seal between the upper end of a production tubing and the inner surfaces of a blow out control valve assembly cylindrical housing portion downwardly loosely telescoped over the upper end portion of the production tubing and wherein the cylindrical housing portion includes three axially spaced circumferential and radially inwardly projecting annular abutments sealingly and rigidly mounted therein, providing an annular axially compressible and radially expandable seal assembly between each pair of adjacent annular abutments, and introducing a fluent hardenable seal material under pressure into said cylindrical housing portion in an area thereof disposed intermediate said seal assemblies, whereby to pressurize said seal assemblies from adjacent sides thereof.

11. The method of claim 10 including the step of closing the upper end of said cylindrical housing portion above the upper end of said production tubing and introducing fluent material under pressure into the upper end of said cylindrical housing portion above the uppermost seal assembly therein subsequent to hardening of said fluent seal material.

12. A well blow out control valve assembly, said assembly including an upright tubular housing having upper and lower ends, said housing being adapted to be downwardly telescoped over the upper end of a well production tubing and including two axially spaced radially inwardly projecting circumferential annular abutments sealingly mounted therein, upper and lower annular axially compressible and radially expandable seal assemblies disposed in said housing immediately beneath and above, respectively, the two axially spaced annular abutments, one of said abutments including inwardly shiftable clamp jaws supported therefrom for general radial inward shifting into tight clamping engagement with the opposing outer surfaces of said tubing, and pressurized fluent material inlet means opening into the interior of said housing intermediate said seal assemblies whereby fluent material under pressure may be admitted into said housing intermediate said seal assemblies for applying axial pressure thereagainst from the adjacent sides thereof in order to radially expand said seal assemblies into tight sealed engagement with the opposing outer surfaces of said tubing.

13. The method of forming a fluid-tight seal between the upper end of a production tubing and the inner surfaces of a blow out control valve assembly cylindrical housing portion downwardly loosely telescoped over the upper end portion of the production tubing and wherein the cylindrical housing portion includes two axially spaced circumferentially and radially inwardly projecting annular abutments sealingly and rigidly mounted therein, providing an annular axially compressible and radially expandable seal assembly on the opposing sides of said annular abutments and with seal assemblies axially spaced apart, and introducing a fluent hardenable seal material under pressure into said cylindrical housing portion in an area thereof disposed intermediate said seal assemblies, whereby to axially compress the latter against said annular abutments in sealed engagement therewith and cause the seal assemblies to be radially expanded into tight sealed engagement with the opposing outer surfaces of said production tubing.

* * * * *